US007682576B2

(12) United States Patent
Zhu et al.

(10) Patent No.: US 7,682,576 B2
(45) Date of Patent: Mar. 23, 2010

(54) APPARATUS FOR RECOVERING POWER FROM FCC PRODUCT

(75) Inventors: Xin X. Zhu, Long Grove, IL (US); Keith A. Couch, Arlington Heights, IL (US); James P. Glavin, Naperville, IL (US)

(73) Assignee: UOP LLC, Des Plaines, IL (US)

( * ) Notice: Subject to any disclaimer, the term of this patent is extended or adjusted under 35 U.S.C. 154(b) by 372 days.

(21) Appl. No.: 11/832,143

(22) Filed: Aug. 1, 2007

(65) Prior Publication Data

US 2009/0035193 A1 Feb. 5, 2009

(51) Int. Cl.

| | |
|---|---|
| ***F27B 15/08*** | (2006.01) |
| ***F27B 15/00*** | (2006.01) |
| ***F01K 17/00*** | (2006.01) |
| ***F01K 13/00*** | (2006.01) |

(52) U.S. Cl. ..... 422/144; 422/139; 422/141; 422/143; 422/145; 422/146; 422/147; 60/648; 60/676

(58) Field of Classification Search ..... 422/139, 422/141, 143, 144, 145, 146, 147; 60/648, 60/676

See application file for complete search history.

(56) References Cited

U.S. PATENT DOCUMENTS

| | | | | |
|---|---|---|---|---|
| 3,076,769 | A | 2/1963 | Pfeiffer | 252/417 |
| 3,401,124 | A | 9/1968 | Gulden | 252/417 |
| 3,532,620 | A | 10/1970 | Asmus et al. | 208/113 |
| 3,702,308 | A | 11/1972 | Bauer et al. | 252/417 |
| 4,003,822 | A | 1/1977 | Jo | 208/102 |
| 4,081,508 | A * | 3/1978 | Luckenbach | 423/210 |
| 4,338,788 | A * | 7/1982 | Fink | 60/648 |
| 4,431,529 | A | 2/1984 | Carson | 208/343 |
| 5,114,682 | A * | 5/1992 | Goelzer | 422/142 |
| 5,830,346 | A * | 11/1998 | Harandi et al. | 208/113 |
| 7,074,323 | B2 | 7/2006 | Ghijsen | 208/101 |
| 2001/0044565 | A1 * | 11/2001 | Keady et al. | 585/809 |
| 2006/0096455 | A1 * | 5/2006 | Couch et al. | 95/269 |
| 2007/0034550 | A1 * | 2/2007 | Hedrick et al. | 208/113 |
| 2007/0209367 | A1 * | 9/2007 | Bell et al. | 60/775 |
| 2009/0035191 | A1 * | 2/2009 | Couch et al. | 422/144 |

OTHER PUBLICATIONS

Handbook of Petroleum Refining Processes, Robert A. Meyers, Chemical Process Technology Handbook Series, pp. 21-22.

Handbook of Petroleum Refining Processes, Robert A. Meyers, Chemical Process Technology Handbook Series, pp. 21-22, Publication year 2003.

* cited by examiner

*Primary Examiner*—Walter D Griffin
*Assistant Examiner*—Huy-Tram Nguyen
(74) *Attorney, Agent, or Firm*—James C. Paschall

(57) ABSTRACT

Disclosed is an apparatus for recovering power from an FCC product. The dry gas is combusted and combined with FCC regenerator flue gas to raise the power recovery capability of the flue gas. The flue gas can be used to generate electrical power or steam. Alternatively or additionally, dry gas from an FCC product stream is separated and delivered to an expander to recover power before combustion.

18 Claims, 2 Drawing Sheets

APPARATUS FOR RECOVERING POWER FROM FCC PRODUCT

BACKGROUND OF THE INVENTION

The field of the invention is power recovery from a fluid catalytic cracking (FCC) unit.

FCC technology, now more than 50 years old, has undergone continuous improvement and remains the predominant source of gasoline production in many refineries. This gasoline, as well as lighter products, is formed as the result of cracking heavier (i.e. higher molecular weight), less valuable hydrocarbon feed stocks such as gas oil.

In its most general form, the FCC process comprises a reactor that is closely coupled with a regenerator, followed by downstream hydrocarbon product separation. Hydrocarbon feed contacts catalyst in the reactor to crack the hydrocarbons down to smaller molecular weight products. During this process, the catalyst tends to accumulate coke thereon, which is burned off in the regenerator.

The heat of combustion in the regenerator typically produces flue gas at temperatures of 677° to 788° C. (1250° to 1450° F.) and at a pressure range of 138 to 276 kPa (20 to 40 psig). Although the pressure is relatively low, the extremely high temperature, high volume of flue gas from the regenerator contains sufficient kinetic energy to warrant economic recovery.

To recover energy from a flue gas stream, flue gas may be fed to a power recovery unit, which for example may include an expander turbine. The kinetic energy of the flue gas is transferred through blades of the expander to a rotor coupled either to a main air blower, to produce combustion air for the FCC regenerator, and/or to a generator to produce electrical power. Because of the pressure drop of 138 to 207 kPa (20 to 30 psi) across the expander turbine, the flue gas typically discharges with a temperature drop of approximately 125° to 167° C. (225 to 300° F.). The flue gas may be run to a steam generator for further energy recovery. A power recovery train may include several devices, such as an expander turbine, a generator, an air blower, a gear reducer, and a let-down steam turbine.

In order to reduce damage to components downstream of the regenerator, it is also known to remove flue gas solids. This is commonly accomplished with first and second stage separators, such as cyclones, located in the regenerator. Some systems also include a third stage separator (TSS) or even a fourth stage separator (FSS) to remove further fine particles, commonly referred to as "fines".

The FCC process produces around 30% of the dry gas produced in a refinery. Dry gas comprises mainly methane, ethane and other light gases. Dry gas is separated from other FCC products at high pressures. FCC dry gas is heavily olefinic and typically used as fuel gas throughout a refinery. Olefinic dry gas, such as dry gas having over 10 wt-% olefins is not viable for use in gas turbines in which the olefins can cause internal fouling particularly due to the presence of diolefins. In some cases, FCC units produce more dry gas than the refinery consumes. The excess dry gas can be flared which is an environmental concern. To make less dry gas, the riser temperature can be reduced, adversely affecting the product slate, or throughput can be reduced, adversely affecting productivity. Olefinic dry gas can also be obtained from other unit operations such as those that are hydrogen deficient like cokers and steam crackers.

SUMMARY OF THE INVENTION

We have discovered an apparatus for improving power recovery from an FCC unit. The apparatus involves combusting product gas with oxygen before being combined with an FCC regenerator flue gas stream to heat the flue gas stream. The combined flue gas is then expanded to recover power or heat exchanged to recover heat. The apparatus may involve expanding the high pressure product gas obtained from an FCC product stream to lower pressure to recover power before combustion. The preferred product gas is dry gas which may be obtained from many hydrocarbon processing reactions which are hydrogen deficient.

Advantageously, the apparatus can enable the FCC unit to utilize a low value product stream to produce gasses that are more environmentally friendly.

Additional features and advantages of the invention will be apparent from the description of the invention, figures and claims provided herein.

DETAILED DESCRIPTION

Figure 1:
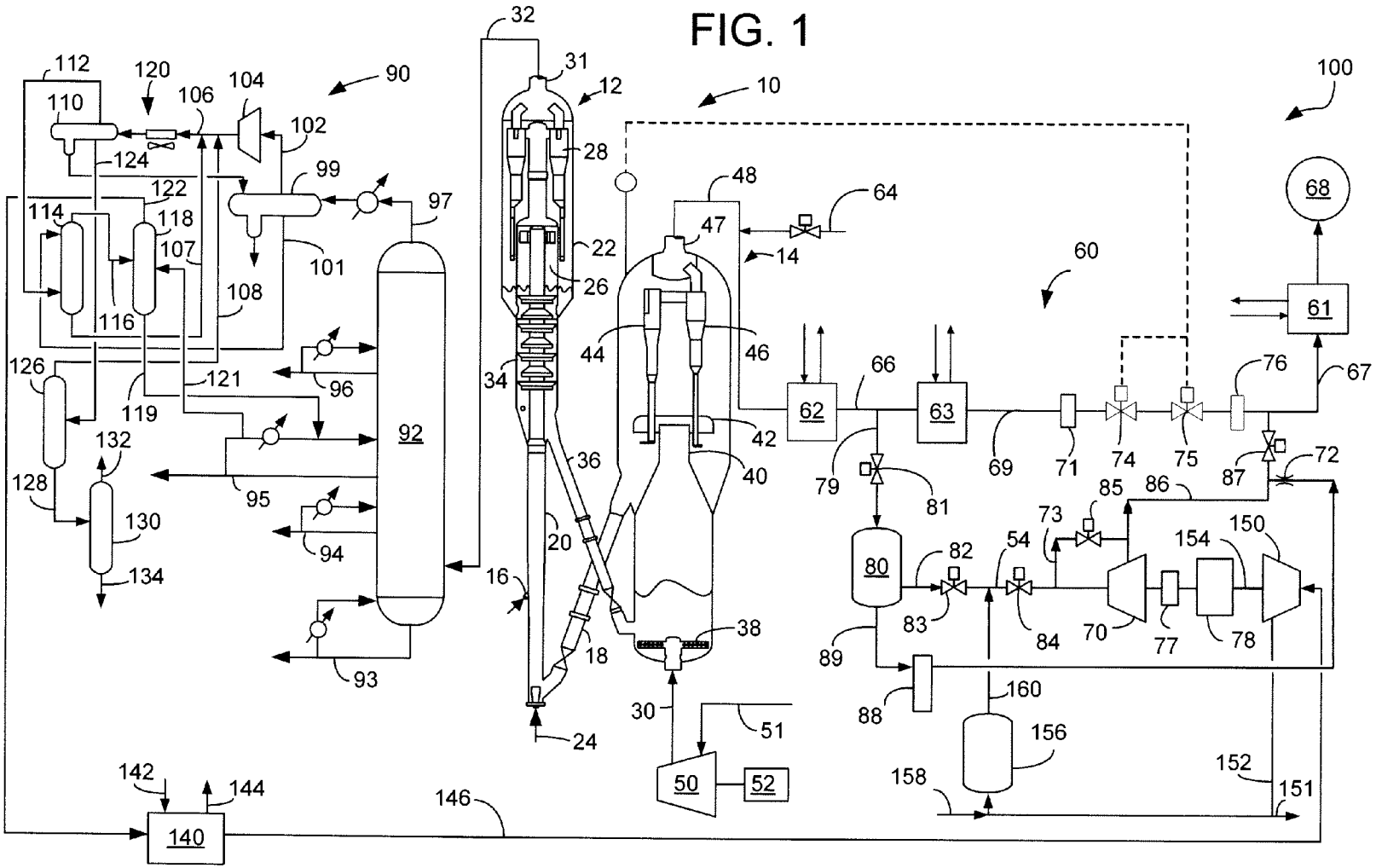
FIG. 1 is a schematic drawing of an FCC unit, a power recovery train and an FCC product recovery system in a refinery.

Now turning to the figures, wherein like numerals designate like components, FIG. 1 illustrates a refinery complex 100 that is equipped for processing streams form an FCC unit for power recovery. The refinery complex 100 generally includes an FCC unit section 10, a power recovery section 60 and a product recovery section 90. The FCC unit section 10 includes a reactor 12 and a catalyst regenerator 14. Process variables typically include a cracking reaction temperature of 400° to 600° C. and a catalyst regeneration temperature of 500° to 900° C. Both the cracking and regeneration occur at an absolute pressure below 5 atmospheres. FIG. 1 shows a typical FCC process unit of the prior art, where a heavy hydrocarbon feed or raw oil stream in a line 16 is contacted with a newly regenerated cracking catalyst entering from a regenerated catalyst standpipe 18. This contacting may occur in a narrow riser 20, extending upwardly to the bottom of a reactor vessel 22. The contacting of feed and catalyst is fluidized by gas from a fluidizing line 24. Heat from the catalyst vaporizes the oil, and the oil is thereafter cracked to lighter molecular weight hydrocarbons in the presence of the catalyst as both are transferred up the riser 20 into the reactor vessel 22. The cracked light hydrocarbon products are thereafter separated from the cracking catalyst using cyclonic separators which may include a rough cut separator 26 and one or two stages cyclones 28 in the reactor vessel 22. Product gases exit the reactor vessel 10 through a product outlet 31 to line 32 for transport to a downstream product recovery section 90. Inevitable side reactions occur in the riser 20 leaving coke deposits on the catalyst that lower catalyst activity. The spent or coked catalyst requires regeneration for further use. Coked catalyst, after separation from the gaseous product hydrocarbon, falls into a stripping section 34 where steam is injected through a nozzle to purge any residual hydrocarbon vapor.

After the stripping operation, the coked catalyst is fed to the catalyst regenerator 14 through a spent catalyst standpipe 36.

FIG. 1 depicts a regenerator 14 known as a combustor. However, other types of regenerators are suitable. In the catalyst regenerator 14, a stream of oxygen-containing gas, such as air, is introduced through an air distributor 38 to contact the coked catalyst, burn coke deposited thereon, and provide regenerated catalyst and flue gas. A main air blower 50 is driven by a driver 52 to deliver air or other oxygen containing gas from line 51 into the regenerator 14 through line 30. The driver 52 may be, for example, a motor, a steam turbine driver, or some other device for power input. The catalyst regeneration process adds a substantial amount of heat to the catalyst, providing energy to offset the endothermic cracking reactions occurring in the reactor conduit 16. Catalyst and air flow upwardly together along a combustor riser 40 located within the catalyst regenerator 14 and, after regeneration, are initially separated by discharge through a disengager 42. Finer separation of the regenerated catalyst and flue gas exiting the disengager 42 is achieved using first and second stage separator cyclones 44, 46, respectively within the catalyst regenerator 14. Catalyst separated from flue gas dispenses through a diplegs from cyclones 44, 46 while flue gas relatively lighter in catalyst sequentially exits cyclones 44, 46 and exits the regenerator vessel 14 through flue gas outlet 47 in line 48. Regenerated catalyst is recycled back to the reactor riser 12 through the regenerated catalyst standpipe 18. As a result of the coke burning, the flue gas vapors exiting at the top of the catalyst regenerator 14 in line 48 contain CO, $CO_2$ and $H_2O$, along with smaller amounts of other species.

Hot flue gas exits the regenerator 14 through the flue gas outlet 47 in a line 48 and enters the power recovery section 60. The power recovery section 60 is in downstream communication with the flue gas outlet 47 via line 48. "Downstream communication" means that at least a portion of the fluid from the upstream component flows into the downstream component. Many types of power recovery configurations are suitable, and the following embodiment is very well suited but not necessary to the present invention. Line 48 directs the flue gas to a heat exchanger 62, which is preferably a high pressure steam generator (e.g., a 4137 kPa (gauge) (600 psig)). Arrows to and from the heat exchanger 62 indicate boiler feed water in and high pressure steam out. The heat exchanger 62 may be a medium pressure steam generator (e.g., a 3102 kPa (gauge) (450 psig)) or a low pressure steam generator (e.g., a 345 kPa (gauge) (50 psig)) in particular situations. As shown in the embodiment of FIG. 1, a boiler feed water (BFW) quench injector 64 may be provided to selectively deliver fluid into conduit 48.

A supplemental heat exchanger 63 may also be provided downstream of the heat exchanger 62. For example, the supplemental temperature reduction would typically be a low pressure steam generator for which arrows indicate boiler feed water in and low pressure steam out. However, the heat exchanger 63 may be a high or medium pressure steam generator in particular situations. In the embodiment of FIG. 1, conduit 66 provides fluid communication from heat exchanger 62 to the supplemental heat exchanger 63. Flue gas exiting the supplemental heat exchanger 63 is directed by conduit 69 to a waste flue gas line 67 and ultimately to an outlet stack 68, which is preferably equipped with appropriate environmental equipment, such as an electrostatic precipitator or a wet gas scrubber. Typically, the flue gas is further cooled in a flue gas cooler 61 to heat exchange with a heat exchange media which is preferably water to generate high pressure steam. Arrows to and from flue gas cooler 61 indicate heat exchange media coming in and heated heat exchange media exiting, which is preferably boiler feed water coming in and steam going out. The illustrated example of FIG. 1 further provides that conduit 69 may be equipped to direct the flue gas through a first multi-hole orifice (MHO) 71, a first flue gas control valve (FGCV) 74, and potentially a second FGCV 75 and second MHO 76 on the path to waste flue gas line 67 all to reduce the pressure of the flue gas in conduit 69 before it reaches the stack 68. FGCV's 74, 75 are typically butterfly valves and may be controlled based on a pressure or temperature reading from the regenerator 14.

In order to generate electricity, the power recovery section 60 further includes a power recovery expander 70, which is typically a steam turbine, and a power recovery generator ("generator") 78. More specifically, the expander 70 has an output shaft that is typically coupled to an electrical generator 78 by driving a gear reducer 77 that in turn drives the generator 78. The generator 78 provides electrical power that can be used as desired within the plant or externally. Alternatively, the expander 70 may be coupled to the main air blower 50 to serve as its driver, obviating driver 52, but this arrangement is not shown.

In an embodiment, the power recovery expander 70 is located in downstream communication with the heat exchanger 62. However, a heat exchanger may be upstream or downstream of the expander 70. For example, a conduit 79 feeds flue gas through an isolation valve 81 to a third stage separator (TSS) 80, which removes the majority of remaining solid particles from the flue gas. Clean flue gas exits the TSS 80 in a flue gas line 82 which feeds a flue gas stream to a combine line 54 which drives the expander 70.

To control flow flue gas between the TSS 80 and the expander 70, an expander inlet control valve 83 and a throttling valve 84 may be provided upstream of the expander 70 to further control the gas flow entering an expander inlet. The order of the valves 83, 84 may be reversed and are preferably butterfly valves. Additionally, a portion of the flue gas stream can be diverted in a bypass line 73 from a location upstream of the expander 70, through a synchronization valve 85, typically a butterfly valve, to join the flue gas in the exhaust line 86. After passing through an isolation valve 87, the clean flue gas in line 86 joins the flowing waste gas downstream of the supplemental heat exchanger 63 in waste flue gas line 67 and flows to the outlet stack 68. An optional fourth stage separator 88 can be provided to further remove solids that exit the TSS 80 in an underflow stream in conduit 89. After the underflow stream is further cleaned in the fourth stage separator 88, it can rejoin the flue gas in line 86 after passing through a critical flow nozzle 72 that sets the flow rate therethrough.

In the product recovery section 90, the gaseous FCC product in line 32 is directed to a lower section of an FCC main fractionation column 92. Several fractions may be separated and taken from the main column including a heavy slurry oil from the bottoms in line 93, a heavy cycle oil stream in line 94, a light cycle oil in line 95 and a heavy naphtha stream in line 96. Any or all of lines 93-96 may be cooled and pumped back to the main column 92 to cool the main column typically at a higher location. Gasoline and gaseous light hydrocarbons are removed in overhead line 97 from the main column 92 and condensed before entering a main column receiver 99. An aqueous stream is removed from a boot in the receiver 99. Moreover, a condensed light naphtha stream is removed in line 101 while a gaseous light hydrocarbon stream is removed in line 102. Both streams in lines 101 and 102 may enter a vapor recovery section 120 of the product recovery section 90.

The vapor recovery section 120 is shown to be an absorption based system, but any vapor recovery system may be used including a cold box system. To obtain sufficient separation of light gas components the gaseous stream in line 102 is compressed in compressor 104. More than one compressor stage may be used, but typically a dual stage compression is utilized. The compressed light hydrocarbon stream in line 106 is joined by streams in lines 107 and 108, chilled and delivered to a high pressure receiver 110. An aqueous stream from the receiver 110 may be routed to the main column receiver 99. A gaseous hydrocarbon stream in line 112 is routed to a primary absorber 114 in which it is contacted with unstabilized gasoline from the main column receiver 99 in line 101 to effect a separation between $C_3^+$ and $C_2^-$. A liquid $C_3^+$ stream in line 107 is returned to line 106 prior to chilling. An off-gas stream in line 116 from the primary absorber 114 may be used as a selected product stream of the plurality of product streams separated from the FCC product in the present invention or optionally be directed to a secondary absorber 118, where a circulating stream of light cycle oil in line 121 diverted from line 95 absorbs most of the remaining $C_5^+$ and some $C_3$-$C_4$ material in the off-gas stream. Light cycle oil from the bottom of the secondary absorber in line 119 richer in $C_3^+$ material is returned to the main column 92 via the pump-around for line 95. The overhead of the secondary absorber 118 comprising dry gas of predominantly $C_2^-$ hydrocarbons with hydrogen sulfide, amines and hydrogen is removed in line 122 and may be used as a selected product stream of the plurality of product streams separated from the FCC product in the present invention. It is contemplated that another stream may also comprise a selected product stream of the plurality of product streams separated from the FCC product in the present invention Liquid from the high pressure receiver 110 in line 124 is sent to a stripper 126. Most of the $C_2^-$ is removed in the overhead of the stripper 126 and returned to line 106 via overhead line 108. A liquid bottoms stream from the stripper 126 is sent to a debutanizer column 130 via line 128. An overhead stream in line 132 from the debutanizer comprises $C_3$-$C_4$ olefinic product while a bottoms stream in line 134 comprising stabilized gasoline may be further treated and sent to gasoline storage.

A selected product stream line, preferably line 122 comprising the secondary absorber off-gas containing dry gas may be introduced into an amine absorber unit 140. A lean aqueous amine solution is introduced via line 142 into absorber 140 and is contacted with the flowing dry gas stream to absorb hydrogen sulfide, and a rich aqueous amine absorption solution containing hydrogen sulfide is removed from absorption zone 140 via line 144 and recovered. A selected product stream line preferably comprising a dry gas stream having a reduced concentration of hydrogen sulfide is removed from absorption zone 140 via line 146. Any of lines carrying product from the FCC reactor 12 including lines 116 or 122 and 146 may serve as selected product lines in communication with the downstream power recovery section 60 to transport a selected product stream from the gas recovery section 120 of the product recovery section 90 to the power recovery section 60. Additionally, dry gas may be delivered to the power recovery section 60 from any other source in the refinery 100 such as a coker unit or a steam cracker unit.

The selected FCC product gas from the product recovery section 90 in line 146 can be used in the power recovery section 60 in a continuous process and in the same refinery complex. The power recovery section 60 is in downstream communication with the vapor recovery section of the product recovery section 90 via line 146. As an alternative to sending the selected gas in line 146 to the refinery fuel gas header, the selected product gas may be let down in pressure at a volume increase across an expander 150 to recover pressure energy from the gas. The selected gas is still at the high pressure utilized in the vapor recovery section 120 of the product recovery section 90 when delivered to the expander 150 due to operation of the compressor 104. The selected gas exits expander 150 in exhaust line 152. The expander is connected by a shaft 154 to an electrical generator 78 for generating electrical power that can be used in the refinery or exported. Beside connection by shaft 154 to the electrical generator, the expander 150 may alternatively or additionally be connected by a shaft (not shown) to the main air blower 50 for blowing air to the regenerator 14 obviating the need for driver 52. A gear reducer may be provided on the shaft 154 between the expander 150 and the generator 78 in which case the gear reducer (not shown) would connect two shafts of which shaft 154 is one. The expander 150 may be in downstream communication with the selected product line 146 and with vapor recovery section 120 of the product recovery section 90 via line 146.

It is also contemplated that an additional steam expander (not shown) may be connected by an additional shaft or the same shaft 154 to further turn electrical generator 78 and produce additional electrical power or power the main air blower 50. The additional steam expander would be fed by surplus steam in the refinery. The additional expander could be either an extraction or induction turbine. In the latter case, the additional expander could take the form of an additional chamber in expander 150 or 70 with the surplus steam feeding the additional chamber (not shown). The additional expander may be coupled by a gear reducer (not shown) to the additional shaft or the same shaft 154. It is also contemplated that expanders 70 and 150 could be the same expander with induction feed from line 82, 54 or 146, respectively, introducing a stream to an intermediate chamber of the expander.

The selected product gas may be used as a flue gas reheating media. Selected product lines 116, 122, 146 and/or 152 communicate the product recovery section 90 with a downstream flue gas heater 156. After, before or instead of power recovery in expander 150 from the selected gas, the selected gas is routed to the flue gas heater 156 in expander exhaust line 152 if the expander 150 is utilized. For example, steam generation in the upstream flue gas power recovery section 60 may have allowed for the majority of the flue gas system to be designed of lower class metallurgy. While this can dramatically reduce the total installed cost of the flue gas power recovery system, it can also reduce the power generation capability across the flue gas expander 70. To regain the electrical power generating capability of the flue gas, selected gas from the product recovery section 90 and suitably from the gas recovery section 120 can be used to re-heat the flue gas on temperature control to a maximum permissible inlet temperature of the expander 70. An oxygen-containing gas such as air may be added to the selected product stream in exhaust line 152 from line 158. The oxygen and the selected gas are ignited continuously to combust the selected gas in the flue gas heater 156 and achieve an elevated temperature. The flue gas heater 156 may be in downstream communication with the expander 150.

In the embodiment of FIG. 1, combust line 160 communicates with and carries hot combusted selected product gas to join line 82 carrying flue gas downstream from the regenerator 14, thus raising the temperature of the flue gas in flue gas line 82 on entering combine line 54. Combust line 160 may deliver hot combusted selected product gas to combine with flue gas stream in flue gas line 82 in downstream communication with the flue gas outlet 47 to line 48 to provide a combined selected product and flue gas stream in combine line 54. Combine line 54 is in downstream communication with the flue gas line 82 and the combust line 160. Combine line 54 communicates lines 82 and 160 with the downstream expander 70. The combine stream of at least a portion of the combusted selected product gas stream with at least a portion of a flue gas stream of elevated temperature are then carried to the expander 70 in line 54 at a higher temperature than in line 82 to produce an even greater quantity of power in the expansion. The expander 70 is in downstream communication with the selected product line 146 and with vapor recovery section 120 of the product recovery section 90 and with line 152. The expander 70 is also in downstream communication with the flue gas heater 156 via lines 160 and 54.

This arrangement is economically attractive as it may maximize utilization of existing assets, but it also allows for the burning of olefin rich dry gas from the FCC reactor 12 or other reactor in which hydrogen is deficient, which is not viable for use in gas turbines in which the olefins can cause internal fouling. The reheated flue gas is processed through the expander 70 for maximum power generation. The outlet line 86 from the expander 70 communicates with a downstream heat exchanger 61 which may be a steam generator via line flue gas lines 69 and 67. The heat exchanger 61 is in downstream communication with the expander 70. The heat exchanger 61 is also in downstream communication with the flue gas heater 156 via lines 160, 54, 86, 69 and 67. The residual heat energy may be recovered by directing the combined selected product and flue gas stream in line 86 to the downstream flue gas cooler 61 via lines 66 and 67. In the flue gas cooler 61, heat exchange media is heat exchanged with the combine stream preferably for steam generation. The power generation capacity of the flue gas in expander 70 may increase by a factor of 1.8 to 2.2 by combining combusted selected product gas from combust line 160 with the flue gas stream in line 82. The selected product gas may be used to reheat the flue gas whether or not it is routed through expander 150, but prior recovery of the pressure energy may be preferable.

Figure 2:
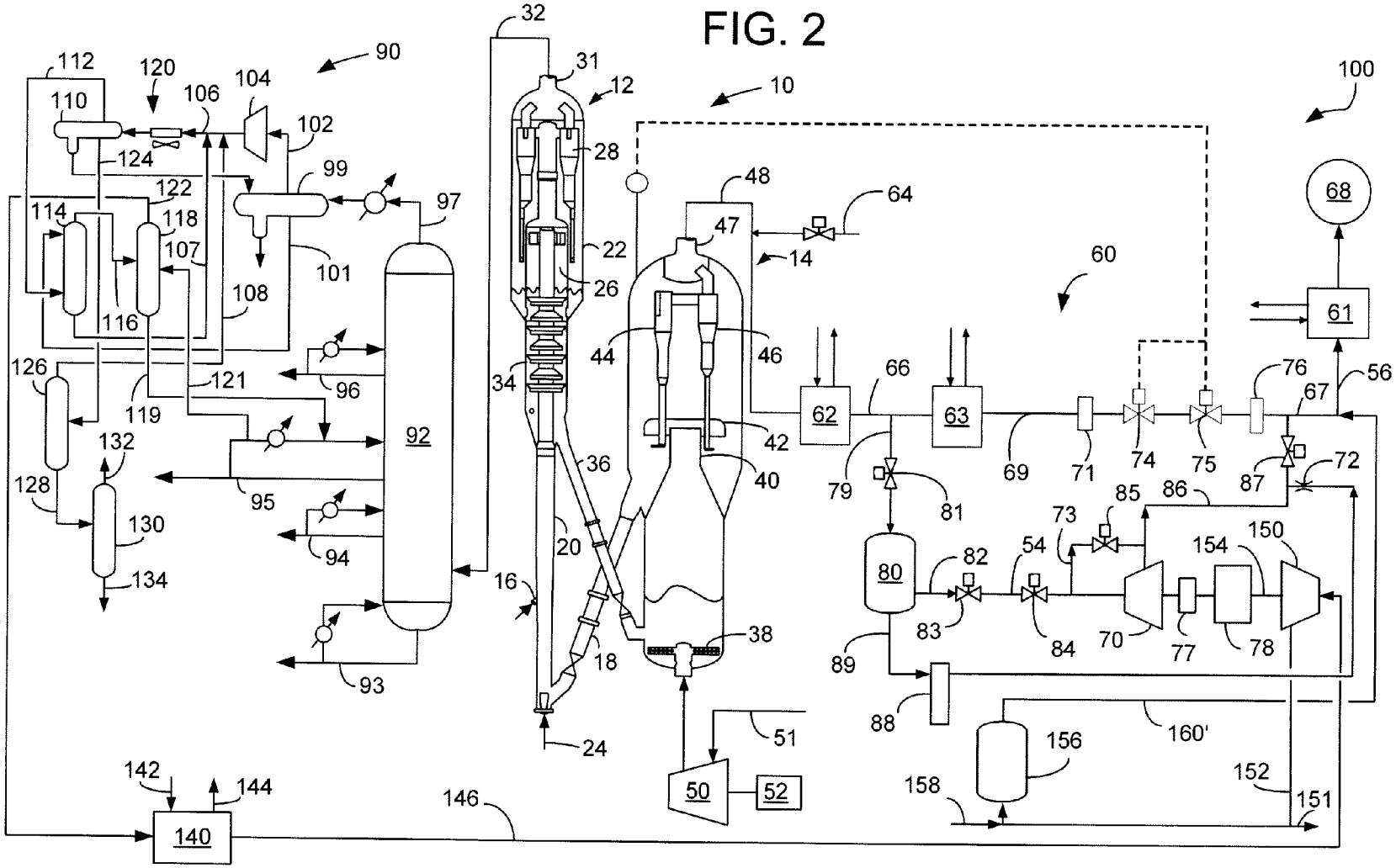
FIG. 2 is a schematic of an alternate embodiment of the invention of FIG. 1.

FIG. 2 shows an alternative embodiment in which most elements are the same as in FIG. 1 indicated by like reference numerals but with differences in configuration indicated by designating the reference numeral with a prime symbol ("'"). The combust line 160' from the flue gas heater communicates with a downstream heat exchanger 61, preferably a steam generator, via a combine line 56. Line 160' feeds combusted selected product gas to join waste flue gas line 67 carrying flue gas downstream of the flue gas outlet 47 of the regenerator 14 to provide a combined combusted selected product and flue gas stream in combine line 56. Line 67 is in downstream communication with the turbine exhaust line 86. Combine line 56 carries the combined selected product and flue gas stream at a higher temperature than the flue gas in waste flue gas line 67 to the flue gas cooler heat exchanger 61 to obtain an even greater heat exchange or recovery of high quality steam. Combine line 56 is in downstream communication with combust line 160' and flue gas line 67. The heat exchanger 61 is in downstream communication with the flue gas heater 156 and lines 160' and 56. It is also contemplated that exhaust line 160' feed lines 48 or 66 to immediately improve steam generation in downstream steam generators 62 or 63, respectively. Therefore, if a refiner has a greater demand for steam than for power, the embodiment of FIG. 2 may be more advantageous than that of FIG. 1.

EXAMPLE

For example, per the following data inputs and calculated output, the dry gas production from an FCC unit would be used to generate a rather substantial 2.05 MW through an expander.

| Dry Gas Stream Property | | |
|---|---|---|
| Mass flow rate | 69380 kg/hr | 152,636 lb/hr |
| Pressure to expander inlet | 13.2 kg/cm$^2$g | 202.4 psia |
| Pressure from expander outlet | 2.5 kg/cm$^2$g | 50.26 psia |
| Temperature at expander inlet | 38° C. | 100° F. |
| Molecular weight | 21.7 | |
| UOP K value | 1.22 | |
| Critical temperature | 427° C. | 801° F. |
| Critical Pressure | 687 kg/cm$^2$g | 9771 psia |

Preferred embodiments of this invention are described herein, including the best mode known to the inventors for carrying out the invention. It should be understood that the illustrated embodiments are exemplary only, and should not be taken as limiting the scope of the invention.

The invention claimed is:

1. An apparatus for processing streams from a fluid catalytic cracking unit comprising:

a fluid catalytic cracking reactor for contacting cracking catalyst with a hydrocarbon feed stream to crack the hydrocarbons to gaseous product hydrocarbons having lower molecular weight and deposit coke on the catalyst to provide coked catalyst;

a product outlet for discharging said gaseous product hydrocarbons from said reactor;

a regenerator for combusting coke from said coked catalyst by contact with oxygen;

a flue gas outlet for discharging flue gas from said regenerator;

a product recovery section in downstream communication with said product outlet, said product recovery section for separating said gaseous products into a plurality of product streams including a selected product stream;

a power recovery section in downstream communication with said flue gas outlet;

said power recovery section in downstream communication with said product recovery section;

a selected product line communicating said product recovery section with a downstream flue gas heater in which the selected product gas is combusted with oxygen and a combust line communicating said flue gas heater with said flue gas line.

2. The apparatus of claim 1 wherein a combine line in downstream communication with said combust line and said flue gas line communicates with a downstream expander for power recovery.

3. The apparatus of claim 2 wherein said expander is coupled to an electrical generator.

4. The apparatus of claim 1 wherein a combine line in downstream communication with said combust line and said flue gas line communicates with a downstream heat exchanger.

5. The apparatus of claim 4 wherein said downstream heat exchanger generates steam.

6. The apparatus of claim 1 wherein an expander in said power recovery section is in downstream communication with said selected product line, and a flue gas heater is in downstream communication with said selected product line.

7. An apparatus for processing streams from a fluid catalytic cracking unit comprising:

a fluid catalytic cracking reactor for contacting cracking catalyst with a hydrocarbon feed stream to crack the hydrocarbons to gaseous product hydrocarbons having lower molecular weight and deposit coke on the catalyst to provide coked catalyst;

a product outlet for discharging said gaseous product hydrocarbons from said reactor;

a regenerator for combusting coke from said coked catalyst by contact with oxygen;

a flue gas outlet for discharging flue gas from said regenerator;

a product recovery section in downstream communication with said product outlet, said product recovery section for separating said gaseous products into a plurality of product streams including a selected product stream;

a power recovery section in downstream communication with said flue gas outlet;

said power recovery section in downstream communication with said product recovery section;

an expander in said power recovery section in downstream communication with a selected product line transporting said selected product stream; and a flue gas heater, in which said selected product stream is combusted with oxygen, in downstream communication with said expander.

8. The apparatus of claim 7 wherein a second expander is in downstream communication with said flue gas heater.

9. The apparatus of claim 8 wherein a heat exchanger is in downstream communication with said second expander.

10. The apparatus of claim 8 wherein a heat exchanger is in downstream communication with said flue gas heater.

11. The apparatus of claim 8 wherein a heat exchanger is in downstream communication with said flue gas heater for steam generation.

12. An apparatus for processing a flue gas stream from a fluid catalytic cracking unit comprising:

a fluid catalytic cracking reactor for contacting cracking catalyst with a hydrocarbon feed stream to crack the hydrocarbons to gaseous product hydrocarbons having lower molecular weight and deposit coke on the catalyst to provide coked catalyst a product outlet for discharging said gaseous product hydrocarbons from said reactor;

a regenerator for combusting coke from said coked catalyst by contact with oxygen;

a flue gas outlet for discharging flue gas from said regenerator;

a source of dry gas;

a power recovery section in downstream communication with said flue gas outlet;

a flue gas heater in downstream communication with said source of dry gas; and said power recovery section in downstream communication with said flue gas heater.

13. The apparatus of claim 12 wherein an expander is in downstream communication with a combine line in downstream communication with said flue gas heater and said flue gas outlet.

14. The apparatus of claim 13 wherein said expander is coupled to an electrical generator.

15. The apparatus of claim 12 wherein a steam generator is in downstream communication with a combine line which is in downstream communication with said flue gas heater and said flue gas outlet.

16. An apparatus for processing streams from a fluid catalytic cracking unit comprising:

a fluid catalytic cracking reactor for contacting cracking catalyst with a hydrocarbon feed stream to crack the hydrocarbons to gaseous product hydrocarbons having lower molecular weight and deposit coke on the catalyst to provide coked catalyst;

a product outlet for discharging said gaseous product hydrocarbons from said reactor;

a regenerator for combusting coke from said coked catalyst by contact with oxygen;

a flue gas outlet for discharging flue gas from said regenerator;

a product recovery section in downstream communication with said product outlet for separating said gaseous products into a plurality of product streams including a selected product stream;

a power recovery section in downstream communication with said flue gas outlet;

an expander in said power recovery section in downstream communication with said product recovery section; and a flue gas heater in downstream communication with said expander for combusting said selected product stream with oxygen.

17. The apparatus of claim 16 wherein a second expander is in downstream communication with said flue gas heater and said flue gas outlet for power recovery.

18. The apparatus of claim 16 wherein a heat exchanger is in downstream communication with said flue gas heater and said flue gas outlet.

* * * * *